US007652218B2

(12) United States Patent
Hoepfl et al.

(10) Patent No.: US 7,652,218 B2
(45) Date of Patent: Jan. 26, 2010

(54) ENERGY STORE

(75) Inventors: Klaus Hoepfl, Maxhütte-Haidhof (DE); Gregor Wilhelm, Regensburg (DE); Silke Wrede, Zeitlarn (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 233 days.

(21) Appl. No.: 11/922,078

(22) PCT Filed: Apr. 29, 2006

(86) PCT No.: PCT/EP2006/004043

§ 371 (c)(1),
(2), (4) Date: Dec. 11, 2007

(87) PCT Pub. No.: WO2006/133767

PCT Pub. Date: Dec. 21, 2006

(65) Prior Publication Data

US 2009/0288934 A1 Nov. 26, 2009

(30) Foreign Application Priority Data

Jun. 15, 2005 (DE) ..... 10 2005 027 527

(51) Int. Cl.
*H01H 3/00* (2006.01)

(52) U.S. Cl. ..... 200/400

(58) Field of Classification Search ..... 200/11 TC, 200/400, 401, 500, 501, 318, 323–327; 137/540; 123/447; 74/640, 436, 2; 307/139; 323/341
See application file for complete search history.

(56) References Cited

U.S. PATENT DOCUMENTS

| | | | | |
|---|---|---|---|---|
| 4,207,445 | A * | 6/1980 | Hammar | 200/11 TC |
| 6,833,518 | B1 * | 12/2004 | Byers et al. | 200/11 TC |
| 6,838,629 | B2 * | 1/2005 | Baertl | 200/501 |
| 6,998,547 | B2 * | 2/2006 | Kloth et al. | 200/6 R |
| 7,518,075 | B2 * | 4/2009 | Wrede et al. | 200/400 |

FOREIGN PATENT DOCUMENTS

| | | |
|---|---|---|
| DE | 1 956 369 | 5/1971 |
| GB | 2 014 794 | 8/1979 |

* cited by examiner

*Primary Examiner*—Michael A Friedhofer
(74) *Attorney, Agent, or Firm*—Andrew Wilford

(57) ABSTRACT

The invention relates to an energy store for a load tap changer with a longitudinally movable lifting carriage and an also longitudinally movable snap-action carriage which follows the movement of the lifting carriage after being triggered and whose longitudinal movement is converted into a rotary movement of an output shaft that actuates the load tap changer. In order to do so, two rolls which are guided in an especially geometrically designed guide rail are disposed on the snap-action carriage. Only one of the two rolls is positively guided in the guide rail during the first part of each movement of the snap-action carriage while the other roll can be moved freely. The second roll that could previously be moved freely is then positively guided during the second part of the movement while the roll which was previously guided can be moved freely. The roll which was initially guided is positively guided once again during the third part of the movement.

5 Claims, 4 Drawing Sheets

ENERGY STORE

CROSS REFERENCE TO RELATED APPLICATIONS

This application is the US national phase of PCT application PCT/EP2006/004043, filed 29 Apr. 2006, published 21 Dec. 2006 as WO 2006/133767, and claiming the priority of German patent application 2005027527.3 itself filed 15 Jun. 2005, whose entire disclosures are herewith incorporated by reference.

The invention relates to an energy accumulator for an on-load tap changer.

On-load tap changers serve for uninterrupted switching between different winding taps of a multiple voltage output transformer under load. Since the switching is generally done suddenly, on-load tap changers normally are provided with an energy accumulator.

Such an energy accumulator is already known from German patent 19 56 369 as well as from the German 28 06 282 [GB 2,014,794]. It is loaded, i.e. tensioned, at the beginning of each actuation of the on-load tap changer by its drive shaft. The known energy accumulator substantially consists of a loading slide and a release slide between which force-storing springs serving as energy accumulators are provided.

In the known energy accumulator guide rods are provided on which the loading slide as well as the release slide are supported for longitudinal movement independent of each other. At the same time, the guide rods support the force-storing springs that each surround a respective one of the guide rods.

The loading slide is moved in a straight line relative to the release slide by an eccentric connected to the drive shaft so that the force-storing springs arranged between are tensioned. Once the loading slide has reached its new end position, latching of the release slide is released. This takes place suddenly but as a straight-line movement of the loading slide braced against the tensioned force-storing spring. From the German 19 56 369 and 28 06 282 referred to at the beginning, it is known to convert this sudden movement of the release slide into a rotational movement of an output shaft by means of a roller engaged in a slot. This known type of conversion of a longitudinal movement into a rotational movement by means of a roller or slide block has the disadvantage of relatively low force being available at the beginning of each movement, the force reaching its maximum at in the middle of each movement and again decreasing toward of the ends of movement. This torque curve is not useful for some types of switching operations where each actuation requires a plurality of contacts to be switched one after the other in a predetermined actuation sequence. Due to the fact that the torque available at the end of each switching is very low, there is also a certain risk that the on-load tap changer might not reach its end position.

Furthermore, WO 2002/031847 [U.S. Pat. No. 6,838,629] discloses conversion of the longitudinal movement of the release slide by means of teeth fitting with a gear connected to the output shaft into a rotational movement. A constant distribution of the force results from this type of conversion, which however is not advantageous for certain kinds of switching sequences. Moreover, the constant torque curve cannot be adjusted.

It is the object of the invention to provide an energy accumulator of the type referred to at the beginning that allows easy variation of the torque curve at the output shaft, i.e. after converting the longitudinal movement of the release slide into rotational movement. In particular, it should be possible to vary the gear ratios and get high torque at the end of the switching operation, making sure that the end position is reached under any circumstance, as well as relatching of the energy accumulator using common technical means.

This object is attained by means of an energy accumulator having the features of the first claim. The dependent claims relate to particularly advantageous improvements of the invention.

The energy accumulator according to the invention with the two rollers that interact with a particularly designed formation in which the rollers are guided and the edges of which they alternately engage, allows for wide adaptation of the specific time and torque curves of the rotational movement of a drive shaft induced by the straight-line sudden movement of the release slide to different switching operations and actuation sequences. The transmission ratio of the energy accumulator, including torque and speed, can be easily modified by altering the distance between both rollers.

Thanks to the described inventive arrangement, high torque is provided in particular at the end of movement of the release slide and consequently of the drive shaft when the switching operation of the on-load tap changer is almost completed.

Hereinafter, the invention is to be described in further detail and by way of example only by means of drawings.

Therein:

FIGS. 1 and 2 show different view of an energy accumulator according to the invention, not all details further described hereinafter being visible in all of the drawings, and consequently, not all reference numbers being indicated. Moreover, in FIG. 1, the force-storing springs are not shown for better representation.

Figure 1:
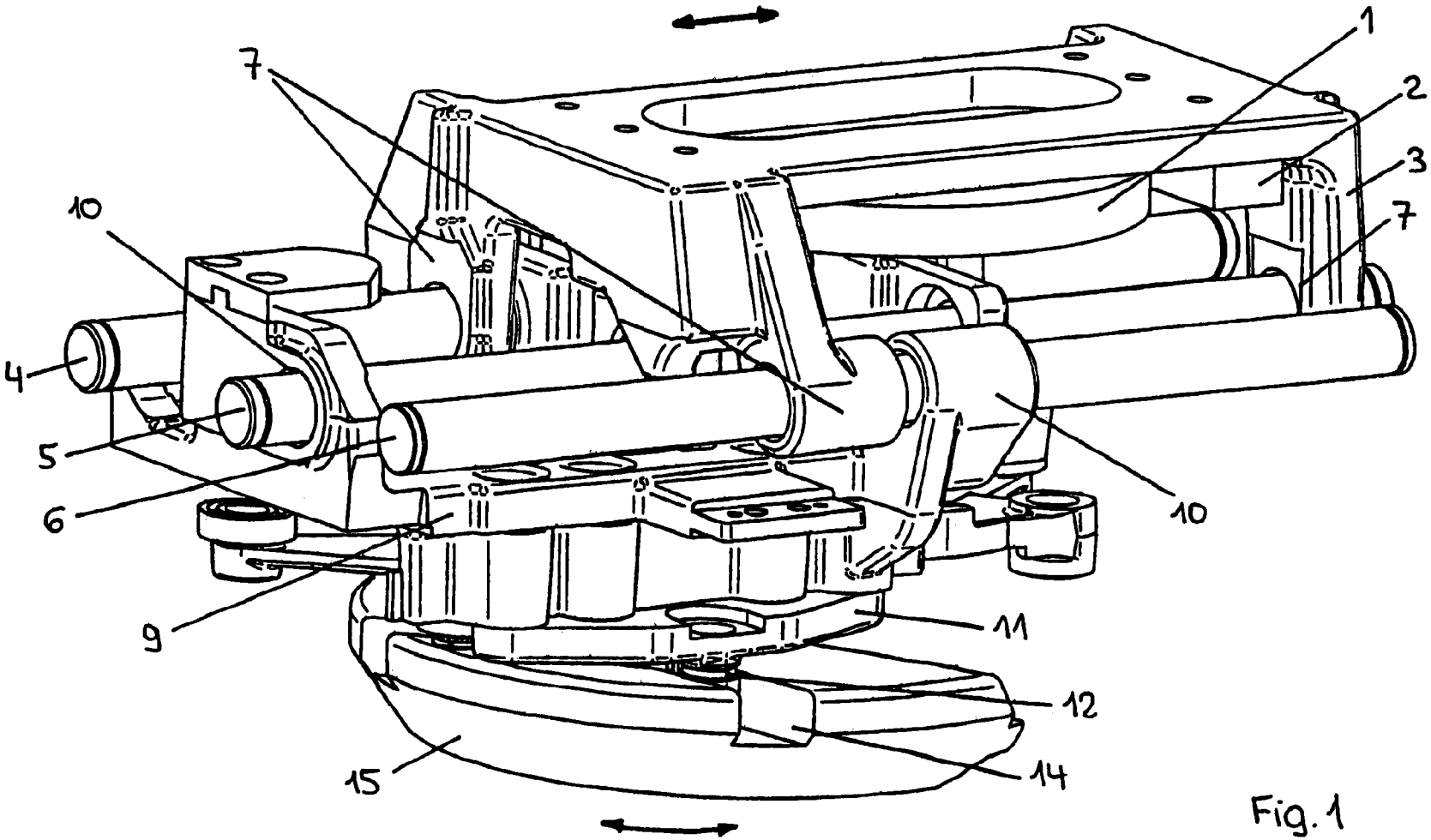
FIG. 1 shows an energy accumulator according to the invention in a perspective, diagonal view from above.
Figure 2:
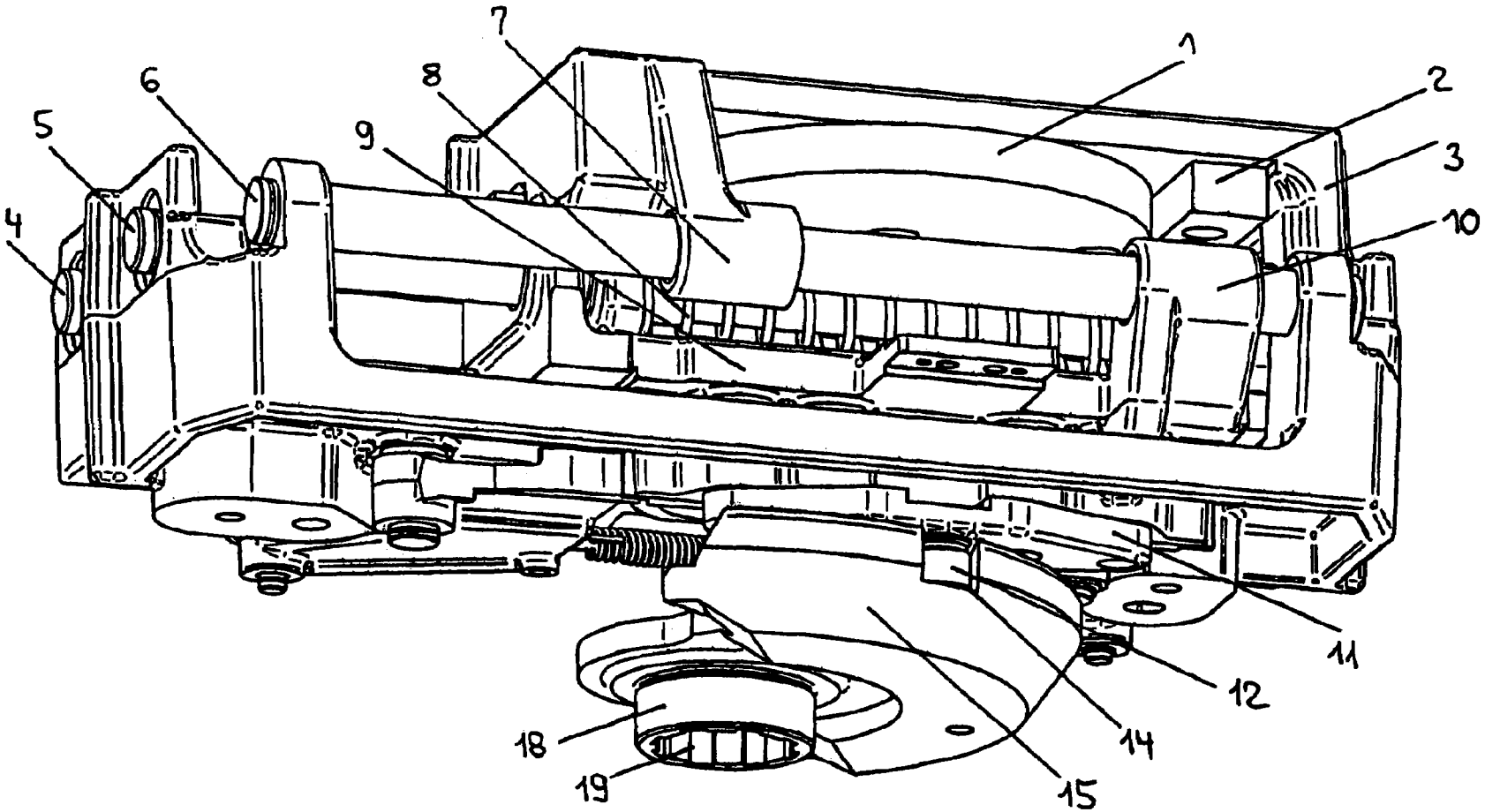
FIG. 2 shows the same energy accumulator in another perspective, diagonal view from below.
Figure 3:
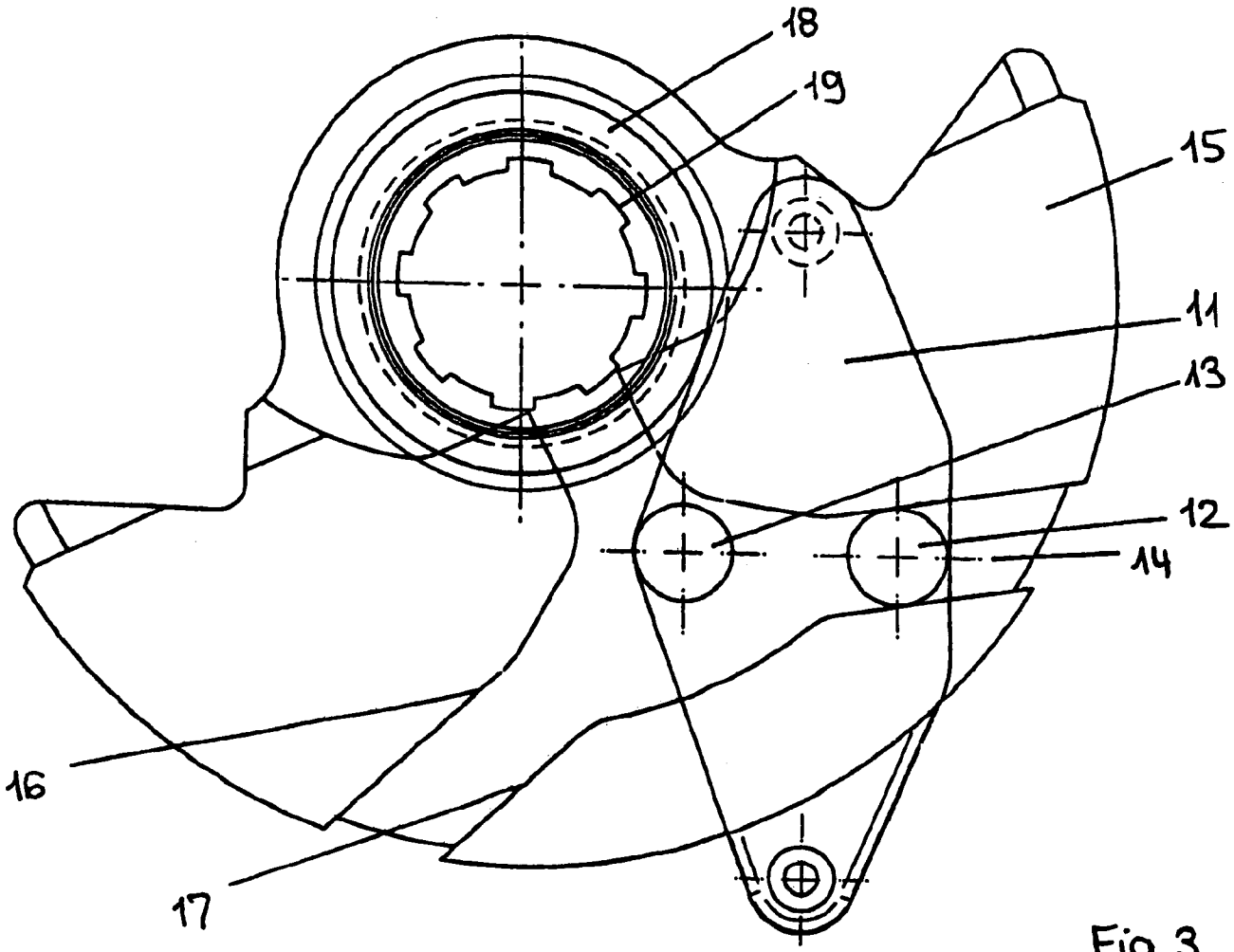
FIG. 3 shows the roller assembly of the inventive energy accumulator from the above.

As known from the state of the art referred to at the beginning, an eccentric disk 1 connected to an unillustrated drive shaft is provided for the herein described energy accumulator, the eccentric disk actuating a loading slide 3 by means of actuating elements 2 flanking it above and below in line with the movement of the loading slide 3. The energy accumulator in this illustrated embodiment has three parallel guide rods 4, 5 and 6 extending parallel to the travel direction of the loading slide 3, two of the guide rods being surrounded by force-storing springs 8. A different number of guide rods and force-storing springs is also possible within the scope of the invention. The loading slide 3 has bearings 7 on both ends that each ride on a respective one of the guide rods 4 or 5 or 6. By means of these linear bearings, the loading slide 3 is solidly mounted and can move along a defined path. The force-storing springs 8 are fixed in the travel direction respectively on the upper and lower ends in a slidable spring pin with one of their extremities and are supported thereby.

A release slide 9 is guided below the loading slide 3 and can be longitudinally moved in the same direction as the loading slide. This release slide 9 in turn has linear bearings 10 on both ends which also each surround a respective one of the guide rods 4, 5, or 6. Within the scope of the invention, other construction designs of loading slide 3 and release slide 9 and their bearings are possible as well. The only thing important is that the loading slide 3 and the release slide 9 move in a straight line as indicated in the figures by double-headed arrows.

A cantilevered support 11 carrying two downwardly projecting rollers 12 and 13 is attached to the release slide 9 on its bottom side facing away from the loading slide 3. These rollers 12 and 13 are arranged such that they are in a horizontal plane and on a line perpendicular to the travel direction of the release slide 9.

Figure 4:
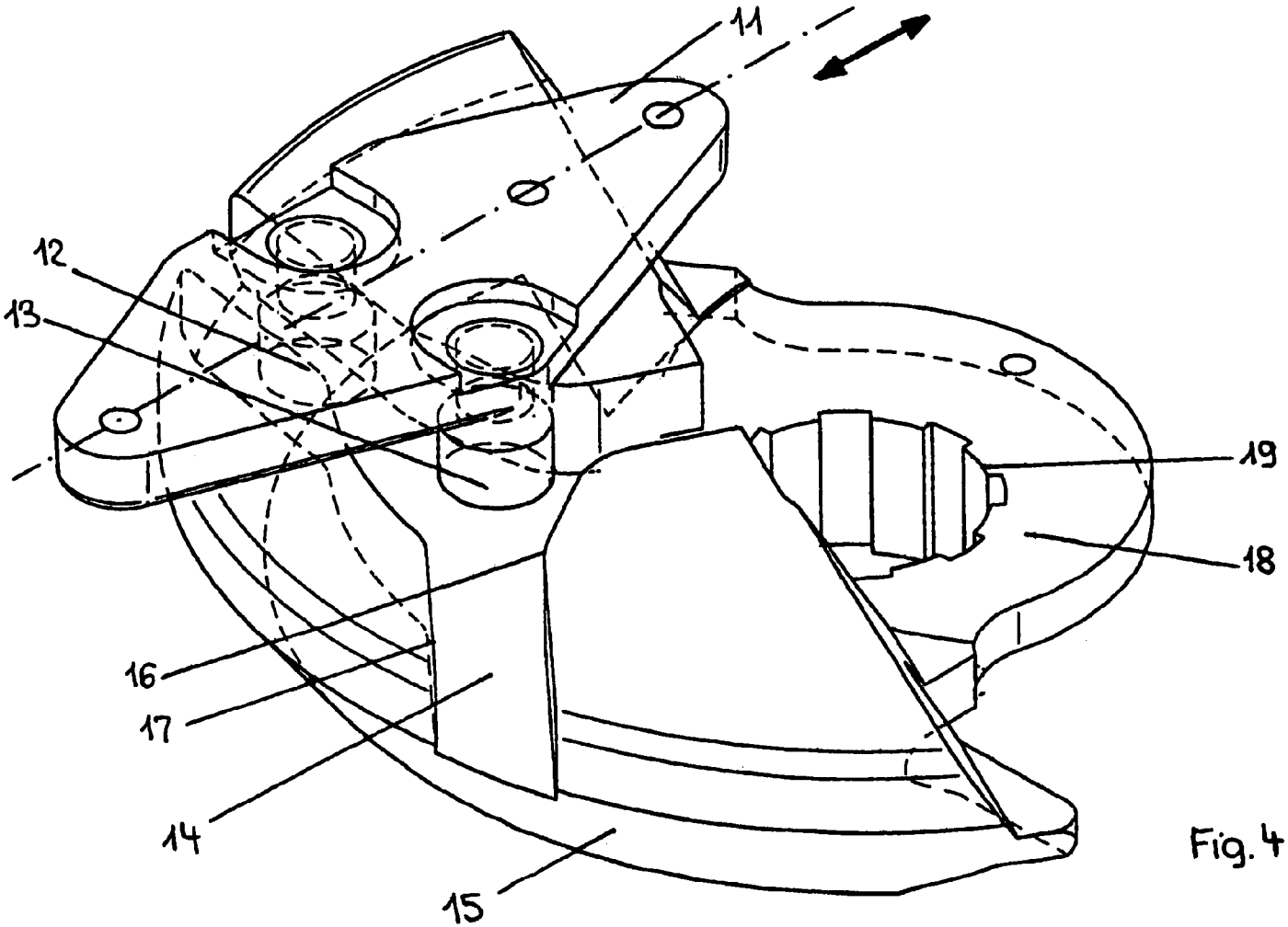
FIG. 4 shows the roller assembly in schematic, perspective view diagonally from above.

This is especially clear from FIG. 4. The movement direction of the support 11 shown there, which corresponds to that of the release slide 9, is illustrated by a double-headed arrow. Both rollers 12 and 13 are attached to the support 11 in a line perpendicular thereto. The free, downwardly projecting rollers can rotate.

Both rollers 12 and 13 interact with a formation 14, which is formed as a groove in a flywheel 15. The formation 14 with its special shape is further described below.

The flywheel 15 in turn is connected to an output hub 18 that has splines 19 connecting it to an unillustrated output-shaft that transmits the generated rotational movement to the on-load tap changer and thus operates it.

The already mentioned groove 14 has an inner flank 16 as well as an outer flank 17 and centrally the flanks 16 and 17 are not parallel to each other. In other words the width of the formation 14 is not constant, but changes. The formation 14 is Y-shaped, so that the distance between the inner flank 16 and the outer flank 17 near the ends of the three legs of the Y is approximately constant and at least approximately corresponds to the diameters of the rollers 12 and 13. Thus, at the ends at least one of the two rollers 12 and 13 can be positively guided. In its central area, the width of the formation 14 increases, so that in this area one of the two rollers 12 or 13 can move freely.

The movement sequence during loading of the energy accumulator according to the invention is as follows: An unillustrated drive shaft and eccentric disk 1 connected to it begin to turn continuously and slide on the respective slide block 2 to displace the loading slide 3 longitudinally on the guide rods 4, 5, and 6. As a consequence, the force-storing springs 8 are loaded. Once the loading slide 3 has approximately reached its opposite new end position, maximum loading of the force-storing springs 8 is achieved. Until this moment, the release slide 9 is still latched, so that it cannot follow the movement of the loading slide 3. Shortly before the loading slide 3 reaches its new end position, the latching is released by means of an appropriate actuating element. This is in principle known from the state of the art. As a result of latching being released, the release slide 9 now, due to the force of the stretched force-storing springs 8, suddenly follows the movement of the loading slide 3. When it has reached its new end position, it is latched again, i.e. a mechanical latch arrests the release slide 9 in its new position; the energy accumulator is ready for the next switching operation.

The support 11 attached to the activated release slide 9 moves together with it. The two rollers 12, 13 attached to the support 11 make the same sudden straight-line movement on parallel paths. At first, the roller 12 positively engages the formation 14 of the flywheel 15. The other roller 13 at first is freely movable within the inner, wider part of the formation 14. Upon progression of the straight-line movement of the two rollers 12 and 13, the first roller 12 at first positively engaged turns the flywheel 15 until this roller 12 reaches the central, wider part of the formation 14 due to this rotation. Thanks to this rotation of the flywheel 15, the relative position of the formation 14 to the rollers 12, 13 is altered. Subsequently, the second roller 13 which hitherto had been freely movable now positively engages the formation 14 and turns it and thus the flywheel 15 in the same direction in its central area. Subsequently, the first roller 12 is positively engaged again until the end position is reached. Simultaneously, the second roller 13 now is disengaged again and can move freely without being positively locked.

The straight-line movement of the release slide 9 is converted into a rotational movement of the flywheel 15 by means of the two rollers 12 and 13 in three consecutive steps: At first by positive engagement of the first roller 12 in the groove 14 while the second roller 13 is freely movable, subsequently by positive engagement of the second roller 13 in the formation 14 while the first roller 12 is being freely movable, and finally by positive engagement of the first roller 12 in the formation 14 while the second roller 13 is freely movable.

Particularly advantageously, smoothing of the generated rotation can be achieved by the mass of the flywheel 15.

The next time the energy accumulator is actuated, the described movement sequence of loading slide 3 and release slide 9 as well as the conversion of its straight-line movement into a rotational movement of the flywheel 15 by means of the rollers 12, 13 and the formation 14 is made in the other direction. The movement sequences of the individual components thus have opposed directions; the energy accumulator has left and right end positions between which switching is alternately effected for any switching operation.

The described conversion of straight-line movement into rotational movement has several advantages for the energy accumulator: At first, a variable transmission ratio is achieved and high torque is produced especially at the beginning and at the end of actuation of the on-load tap changer when such torque is needed most. High torque is particularly important especially at the end of each switching operation for assuring that the end position of the energy accumulator is safely reached, that it is reliably latched in its end position and that thus the on-load tap changer reaches its new fixed position after the switching operation. These objectives are achieved by the invention.

Furthermore, the shape of the formation 14 is widely variable. The inner flank 16 as well as the outer flank 17 can be altered in many ways as far as their shape and the spacing between them are concerned. Thus, adaptation to different switching operations and actuation sequences of the multiple on-load tap changers is possible.

The invention claimed is:

1. An energy accumulator for an on-load tap changer having a longitudinally movable loading slide connected to a drive shaft and an also longitudinally movable release slide connected to an output shaft, at least one force-storing spring being provided between the loading slide and the release slide, the loading slide being movable in a straight line alternatively in one of two opposed directions upon each switching of the on-load tap changer by the rotating drive shaft so that the force-storing spring can be loaded, after reaching the new end position of the loading slide, the hitherto locked release slide being released such that it suddenly follows the movement of the loading slide, and the straight-line movement of the release slide being converted into a rotational movement of the output shaft, characterized in that two rollers are disposed on a side of the release slide facing the output shaft, the rollers sliding in a rotatable formation facing them, the formation also being connected to the output shaft, the formation has an inner flank as well as an outer flank that are designed such that during a first part of each movement of the release slide the first roller is a first positively guided in the formation and the second roller can be moved freely, that during a second part of each movement of the release slide, the second roller that until then was freely movable is positively guided and the first roller that was until then positively guided is freely movable, and that during a third part of each movement the first roller that was until then freely movable is positively guided again, and the second roller that was until then positively guided is freely movable.

2. The energy accumulator according to claim 1 wherein the formation is generally Y-shaped, the distance between the inner flank and the outer flank near the outer ends of legs of the Y-shaped trajectory is constant and substantially corresponds to diameters of the rollers, and a width of the formation increases in a central area thereof such that one of the two rollers can move freely in this area.

3. The energy accumulator according to claim 1 wherein a support carrying the two rollers is attached to the release slide.

4. The energy accumulator according to claim 1 wherein both rollers are in a horizontal plane and on a line perpendicular to a travel direction of the release slide.

5. The energy accumulator according to claim 1 wherein the formation is formed in a flywheel that in turn is connected to the output shaft.

* * * * *